US006357854B1

(12) United States Patent
Igval et al.

(10) Patent No.: US 6,357,854 B1
(45) Date of Patent: Mar. 19, 2002

(54) INK JET PRINTER HAVING WASTE TANK OVERFLOW PREVENTION

(75) Inventors: Yakup J. Igval, Milford, CT (US); Yoshio Tsuru, Cordova, TN (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/558,357

(22) Filed: Apr. 26, 2000

(51) Int. Cl.[7] ..... B41J 2/165
(52) U.S. Cl. ..... 347/36; 347/29
(58) Field of Search ..... 347/36, 23, 29, 347/30, 33, 86

(56) References Cited

U.S. PATENT DOCUMENTS

| | | | | |
|---|---|---|---|---|
| 4,571,600 A | | 2/1986 | Hara | 347/28 |
| 4,577,203 A | | 3/1986 | Kawamura | 347/30 |
| 4,965,596 A | | 10/1990 | Nagoshi et al. | 347/36 |
| 5,172,140 A | | 12/1992 | Hirabayashi et al. | 347/36 |
| 5,248,999 A | | 9/1993 | Mochizuki et al. | 347/23 |
| 5,266,975 A | | 11/1993 | Mochizuki et al. | 347/23 |
| 5,856,834 A | | 1/1999 | Murphy, III | 347/23 |
| 6,126,265 A | * | 10/2000 | Childers et al. | 347/23 |
| 6,174,042 B1 | * | 1/2001 | Kobayashi et al. | 347/23 |

* cited by examiner

*Primary Examiner*—N. Le
*Assistant Examiner*—Shih-wen Hsieh
(74) *Attorney, Agent, or Firm*—Angelo N. Chaclas; Michael E. Melton

(57) ABSTRACT

An ink jet printer includes a supply of ink, a print head, a cap, a waste tank and a control system. The print head is operatively connected to the supply of ink and ejects drops of ink to form an image. The cap is arranged to receive waste ink from the print head during maintenance operations. The waste tank is operatively connected to the cap for storing the waste ink. The control system is operatively connected to the print head for keeping an estimate of a volume of waste ink that has been discharged into the waste tank and adjusting the waste ink estimate to compensate for evaporation of the waste ink.

20 Claims, 2 Drawing Sheets

INK JET PRINTER HAVING WASTE TANK OVERFLOW PREVENTION

FIELD OF THE INVENTION

This invention relates to an ink jet printer. More particularly, this invention is directed to an ink jet printer including a waste tank and a technique, embodied in a method and system, for preventing overflow of the waste tank.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver and control electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. In other embodiments an "off axis" ink supply. In these types of systems, the print head is typically a permanent or semi-permanent component while detachable replaceable ink supply cartridges are employed. Suitable plumbing connects the permanent print head with the ink supply cartridges.

Additionally, the printer typically includes a maintenance module for maintaining the print head in proper working order. The maintenance module includes a cap for sealing the print head off from ambient air while the print head is not in use, a wiper blade for wiping excess ink and moister from the nozzle face of the print head at selected intervals, a pump for supplying vacuum to the print head via the cap and a waste ink storage tank also operatively coupled to the cap. During maintenance operations, such as: flushes, purges, power flushes, power purges and the like, the print head is capped and vacuum may be applied. The maintenance operations expel and/or draw waste ink out of the print head. So as not to spill waste ink out of the printer, the waste ink is contained within a waste ink tank. Typically, the waste ink tank includes a sealed plastic housing, an absorbent material (foam, etc.) located within the housing for keeping the waste ink from splashing during handling of the printer and suitable plumbing for connecting the housing with the cap.

Although the waste ink tank is usually sized to accommodate the anticipated use and expected life of the printer, it is difficult to strike an efficient balance between: anticipated usage, expected life and other considerations, such as: space, cost and risk. For example, a lower risk solution (very remote chance of saturating the absorbent material and causing a leak) may result in undesirable space and cost consequences. As another example, a higher risk solution may result in some users experiencing waste ink leakage.

To help address this issue, attempts have been made to monitor the amount of waste ink in the waste tank so that a warning can be provided before the waste tank overflows. Various monitoring techniques, both active and passive, have been developed. One approach is to place a sensor, such as a thermister, float or the like, within the waste tank so that the level of the waste ink may be actively discerned. Although this type of approach works generally well, adding sensors along with their associated circuitry adds complexity and cost to the printer.

Various passive approaches, such as the one described in U.S. Pat. No. 5,266,975, rely on counting ink drops that have been discharged into the waste tank. By counting the number of drops and using an estimate of the drop volume, an approximate amount of waste ink that has been discharged may be calculated. Although this type of approach works generally well, the waste ink discharge estimate may not be a reliable indicator of an actual amount of capacity of the waste ink tank that has been consumed.

Therefore, there is a need for an improved ink jet printer that accurately tracks the amount of ink accumulated in the waste ink without adversely impacting the cost or complexity of the printer.

SUMMARY OF THE INVENTION

In accordance with the present invention, there is provided an improved ink jet printer that more accurately tracks the amount of ink accumulated in the waste tank without adding costly sensors or other active devices to the waste tank. The ink jet printer includes a supply of ink, a print head, a cap, a waste tank and a control system. The print head is operatively connected to the supply of ink and ejects drops of ink to form an image. The cap is arranged to receive waste ink from the print head during maintenance operations. The waste tank is operatively connected to the cap for storing the waste ink. The control system is operatively connected to the print head for keeping an estimate of a volume of waste ink that has been discharged into the waste tank and adjusting the waste ink estimate to compensate for evaporation of the waste ink.

In accordance with the present invention, there is also a corresponding method of operating the ink jet printer summarized above and described in detail below.

Therefore, it should now be apparent that the present invention substantially overcomes the disadvantages associated with the prior art. Additional advantages of the invention will be set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Postage printing systems are well known in the art. Generally, these systems are readily available from manufacturers such as Pint Bowes Inc. of Stamford, Conn. They often include a variety of different modules which automate the processes of producing mailpieces. A typical high end postage printing system includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying/printing evidence of postage, accounting for postage used and stacking finished mailpieces. However, the exact configuration of each postage printing system is particular to the needs of the user. Customarily, the high end postage printing system also includes a transport apparatus which feeds the mailpieces in a path of travel through the successive modules of the postage printing system.

Figure 1:
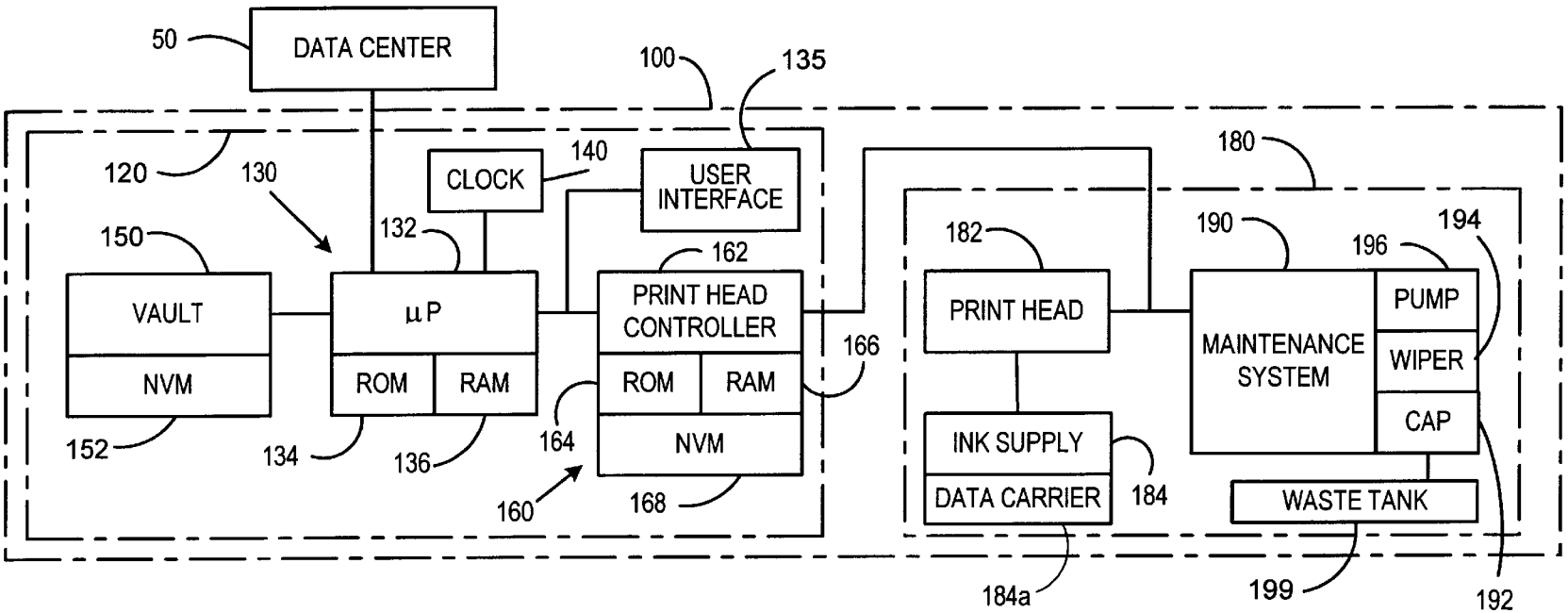
FIG. 1 is a simplified schematic of a postage printing system employing an ink jet printer of present invention.

Referring to FIG. 1, a simplified schematic of a postage printing system 100, including a postage metering portion 120 and an ink jet printer 180. Since a detailed discussion of the postage printing system 100, and more particularly the postage metering portion 120, is not necessary for an understanding of the present invention, the description of the postage printing system unrelated to the present invention will be limited. Periodically, the postage metering portion 120 of the postage printing system 100 contacts a data center 50 to download postal funds or for remote inspections. Typically, this is accomplished over ordinary telephone lines, local area networks or other suitable communication pathway.

The postage metering portion 120 includes a central micro controller 130, a user interface 135, a clock 140, a vault module 150 and a printer controller module 160. The central micro controller 130 includes a suitable processor 132, an associated read only memory (ROM) 134 and an associated random access memory (RAM) 136. The user interface 135 may be of a conventional variety, such as: LCD display (not shown) and keyboard (not shown). The clock 140 is in communication with the processor 132 for providing real time clock data. The vault module 150 accounts for postage used and includes a non-volatile memory (NVM) 152 for storing various accounting and postal information (not shown), such as: an ascending register, a descending register, a control sum register and a postal identification serial number. The vault module 150 is also in communication with the processor 132 for receiving appropriate read and write commands from the processor 132. The printer controller module 160 is also in communication with the processor 132 and includes a print head controller 162 an associated ROM 164, an associated RAM 166 and an associated NVM 168. The print head controller 162 oversees operation of the printer 180 by providing suitable drive signals and other instructions. Alternatively, the printer controller module 160 could be located within the ink jet printer 180.

The printing portion 180 includes conventional components as are known in the art: a print head 182, a replaceable cartridge 184 containing a supply of ink and optionally including a data carrier 184*a*, and a maintenance system 190 having a cap 192, a wiper blade 194, a pump 196 and a waste ink tank 199. In a maintenance position (not shown), the print head 182 is sealed off from ambient air by the cap 192, while in a print position (not shown), the print head 182 is located proximate to a mailpiece (not shown) so as to print a postal indicia (not shown) or other message. The wiper blade 194 periodically cleans the print head 182 to remove any excess ink or other debris (not shown) that may have accumulated on the print head 182. The pump 196 is coupled to the cap 192 and selectively energized in response to signals from the print head controller 162 so as to produce a negative pressure at the cap 192. In this manner, ink can be drawn out of the print head 182 while the print head 182 is in the maintenance position. The cap 192 is operatively connected to the waste ink tank 199 by any conventional plumbing, such as flexible tubing. In this manner, when the maintenance operations (flushes, purges, and the like) are conducted on the print head 182, the waste ink (not shown) is accumulated in the waste ink tank 199. Additionally, the print head 182 receives suitable drive signals from the print head controller 162 so as to selectively energize the plurality of ejection elements (not shown).

For use in preventing waste tank 199 overflow, a plurality of operational parameters are stored in the print head controller NVM 168. The parameters are identified in Table 1 and described in greater detail below. The maximum volume of the waste tank $V_{max}$ is established according to the capacity of the waste tank 199. Thus, the size of the waste tank 199 is used to establish $V_{max}$.

TABLE 1

Operational Parameters

| Variable Name | ID | Value |
|---|---|---|
| Maximum Waste Tank Volume | $V_{max}$ | 300 |
| Threshold #1 | $T_1$ | .85 |
| Threshold #2 | $T_2$ | .90 |
| Evaporable Content of Ink | $E_{ink}$ | .50 |
| Evaporable Content of Shipping Fluid | $E_{ship}$ | .15 |

In this instance, $V_{max}$ is set equal to 300 cubic centimeters. A first threshold value $T_1$ is established to define a warning point when the waste ink tank 199 is nearing capacity and represents a percentage of the capacity of the waste tank 199. In this instance, $T_1$ is set equal to 85 percent. A second threshold value $T_2$ is established to define a point when the waste ink tank 199 is in danger of overflowing and printing operations will be disabled. Here again, $T_2$ represents a percentage of the capacity of the waste tank 199 and is selected based on the accuracy of the waste ink estimates and a desired safety margin. In this instance, $T_2$ is set equal to 90 percent. An evaporable content of ink $E_{ink}$ is established to define that percentage of the ink that will evaporate over time. In this instance, $E_{ink}$ is set equal to 50 percent. An evaporable content of shipping fluid $E_{ship}$ is established to define that percentage of the shipping fluid (not shown) that will evaporate over time. In some ink jet printers, shipping fluid is used in the print head to protect the print head 182 during storage periods. At first installation, the shipping fluid is purged from the print head 182 in conventional manner prior to normal operations beginning. In this instance, $E_{ship}$ is set equal to 15 percent.

Figure 2:
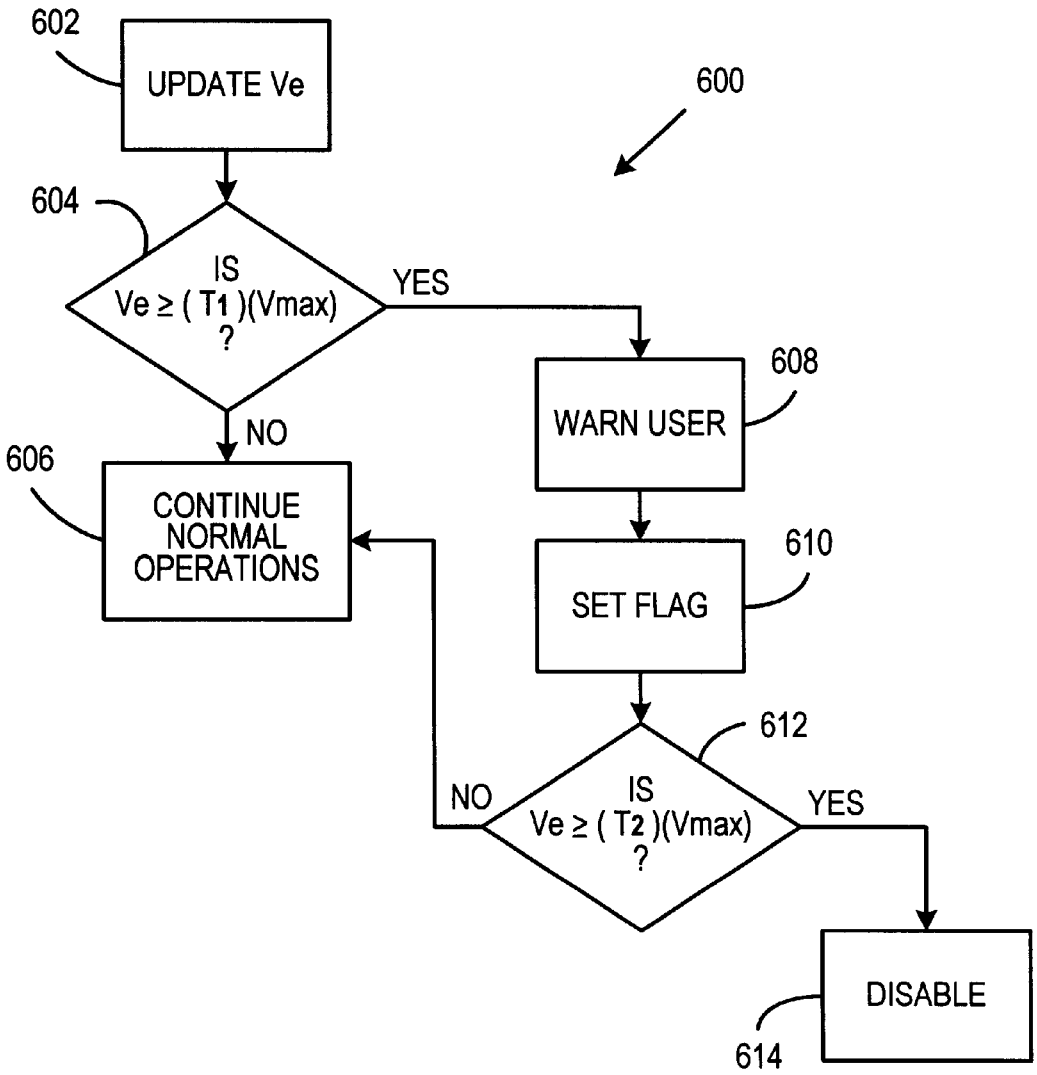
FIG. 2 is a routine performed by the postage printing system to prevent overflow of a waste tank in accordance with the present invention.

With the structure of the invention described as above, the operational characteristics will now be described with reference to FIG. 2 while recalling the detailed structures described above. Referring to FIG. 2 in view of FIG. 1, a waste tank overflow prevention routine 600 run by the print head controller 162 is shown. The routine 600 may be run in response to any predetermined event, such as: system power up, instruction to perform a maintenance operation, and/or any other desired event. At 602, an estimate of a volume of waste ink $V_e$ in the waste tank 199 is updated. Basically, the estimate of the volume of waste ink $V_e$ is derived from passive techniques such as: (i) counting ink and shipping fluid drops and using an anticipated drop volume to calculate total volume; (ii) counting maintenance operations and using an anticipated operation volume to calculate total volume; or some other suitable technique. Further, the volume of waste ink $V_e$ includes an adjustment that compensates for evaporation. The estimate of the volume of waste ink $V_e$ is maintained according to the following formula:

$$V_e=\Sigma V_{ship}+\Sigma V_{ink} \quad (1)$$

where $\Sigma V_{Ship}$ is the sum of all shipping fluid discharges into the waste tank 199 and $\Sigma V_{ink}$ is the sum of all ink discharges into the waste tank 199. In turn, each shipping fluid discharge $V_{ship}$ is defined according to the following formula:

$$V_{ship}=V_{ship}-V_{ship}\{E_{ship}\}\{F_{ship}(t)\} \quad (2)$$

where the expression $V_{ship}\{E_{ship}\}\{F_{ship}(t)\}$ represents an evaporation rate of the shipping fluid as a function of time. Generally, any suitable expression may be employed to account for evaporation. In the preferred embodiment, a function $F_{ship}(t)$ is employed that equals zero (0) at time equal to zero (0) and equals one (1) at time equal to anticipated evaporation duration for the shipping fluid. As a result, at time equal to zero (0), the expression $V_{ship}\{E_{ship}\}\{F_{ship}(t)\}$ equals zero (0) and as a result $V_{ship}$ equals its original discharge volume. On the other hand, after the anticipated evaporation duration for the shipping fluid, the term $F_{ship}(t)$ equals one (1) and the expression $V_{ship}-V_{ship}\{E_{ship}\}\{F_{ship}(t)\}$ reduces to $V_{ship}-V_{ship}\{E_{ship}\}$ which equals 0.85 $V_{ship}$ ($V_{ship}-0.15\ V_{ship}$). Thus, the shipping fluid discharge $V_{ship}$ in the waste tank 199 becomes 85 percent of what was originally present. An example of the function $F_{ship}(t)$ that may be employed is $\{1-\{1/C^t\}\}$ where C equals a constant representative of the shipping fluid's evaporation rate and the variable t equals elapsed time. Those skilled in the art will appreciate that the ink discharge estimate $V_{ink}$ may be maintained in analogous fashion to $V_{ship}$, as described above, and therefore, for the sake of brevity, no further details concerning the ink discharge estimate $V_{ink}$ will be provided.

It should now be appreciated that the waste ink estimate $V_e$ in the waste tank 199 is updated according to the amount of discharged shipping fluid and waste ink with an adjustment for evaporation. Once the waste ink estimate $V_e$ has been updated at 602, next at 604 a determination is made as to whether or not $V_e$ is greater than or equal to a first threshold $T_1$ times the maximum waste tank volume $V_{max}$. If the answer is no, then at 606, normal operations of the printer 180 are continued. On the other hand, if at 604 the answer is yes, then at 608, a warning is issued to the operator. This warning make take the form of an audible and/or visual message provided to the operator via the user interface 135. Furthermore, the warning may also instruct the operator to call customer service. Next, at 610 as an option, a flag is set in meter memory 152 indicating that the first threshold has been exceeded. The use of this flag will be described in greater detail below. Next, at 612, a determination is made as to whether or not $V_e$ is greater than or equal to a second threshold $T_2$ times the maximum waste tank volume $V_{max}$. If the answer is no, then at 606, normal operations of the printer 180 are continued. On the other hand, if at 612 the answer is yes, then at 614, the printer 180 is disabled from performing further maintenance operations that discharge ink into the waste tank 199. In this way, overflow of the waste tank 199 is prevented.

Those skilled in the art will now appreciate that the present invention provides significant advantages over the prior art. By accounting for evaporation, the waste ink discharge estimate $V_e$ provides an improved indicator of an actual amount of capacity of the waste ink tank 199 that has been consumed. Also, the additional optional feature of including shipping fluid (if used) in the waste calculations and treating it on a different evaporation content and evaporation rate than the ink further improves the accuracy of the system. The improved accuracy allows for a greater percentage utilization of the waste tank 199 before disabling the printer 180. This benefit leads to improved system performance (more up time) and lower operating costs for both the manufacturer and the operator.

The first threshold exceeded flag may be used to facilitate and efficiently schedule service calls to replace the waste ink tank 199. From time to time, the postage metering portion 120 of the postage printing system 100 enters into communication with the data center 50. During a communication session, if the data center 50 sees the first threshold exceeded flag in memory 152, then the data center 50 may initiate a service call to replace the waste tank 199 without the need for the operator to call customer service.

Because key operational parameters of the printer 180 are defined as variables in memory 168, the printer 180 of the present invention exhibits improved operational flexibility. For example, when a saturated waste tank 199 is replaced, it may be replaced with one of larger, smaller or the same capacity (it should be understood that $V_e$ is also reset to zero (0) at this time). Instead of having to reprogram the printer 180, the customer service representative merely has to update the number for the maximum volume of the waste tank $V_{max}$ in memory 168. In this way, the operator may purchase the same size waste tank 199 or a different size waste tank 199 depending upon various factors, such as: usage pattern, anticipated remaining life of the printer 180. This provides for increased satisfaction among operators.

Similarly, the other key operational parameters of the printer 180 being defined as variables also provide for improved operational flexibility. For example, if empirical testing or improved anticipated drop volume estimates or other factors allow for a reduction in the safety margin before the printer 180 is disabled, then the first threshold value $T_1$ and the second threshold value $T_2$ may be adjusted by placing new values into memory 168. For instance, 0.88 and 0.93, respectively. This may be accomplished by dispatching a customer service representative to load in the new values or by having the data center 50 download new values during a communication session.

As another example, if changes in the formulation of the shipping fluid or ink occur that influence their evaporation characteristics, then new values for the evaporable contents of the shipping fluid $E_{ship}$ and ink $E_{ink}$ may be provided. Here again, this may be accomplished by dispatching a customer service representative to load in the new values or by having the data center 50 download new values during a communication session. As another alternative, the ink cartridge 184 may contain these values on the data carrier **184*a* so that when a new ink cartridge 184 is installed, the values are obtained from the data carrier 184*a*, in any conventional manner, and written into memory 168. The data carrier 184***a* may employ any type of information storage system, such as: bar code, magnetic stripe or smart chip. As yet another example, still other operational parameters (i.e. evaporation rate constant) of the ink may be parameterized and stored on the data carrier 184*a*. As still yet another example, the pump 196 need not operate and the cap 192 need not seal off the print head 182 during maintenance operations. However, such actions are desirable in most instances.

Many features of the preferred embodiment represent design choices selected to best exploit the inventive concept as implemented in a postage metering system employing an ink jet printer. However, those skilled in the art will recognize that the concepts of the present invention are applicable to any ink jet printer.

Moreover, those skilled in the art will recognize that various modifications can be made without departing from the spirit of the present invention. For example, a single control system may be employed for both the postage metering portion 120 and the printer 180. As another example, the printer 180 may communicate directly with the data center 50 without having the postage metering portion 120 serve as an intermediary. As another example, the ink supply and the print head may be integrated into the same replaceable cartridge or may exist as separate parts.

As still yet another example, the present invention may be adapted for use with an ink jet printer employing more than one type of ink. Some ink jet printers, such as those with color capability, have a concurrent need for different inks. In this application, the present invention contemplates separately tracking the waste discharges of each different ink and providing respective operational parameters for each of the different inks. In this way, the accuracy of the estimate of the waste tank capacity that has been consumed is improved by accounting for different evaporation behavioral characteristics.

Therefore, the inventive concepts in their broader aspects are not limited to the specific details of the preferred embodiments but are defined by the appended claims and their equivalents.

What is claimed is:

1. An ink jet printer, comprising:

a supply of ink;

a print head operatively connected to the supply of ink for ejecting drops of ink to form an image;

a cap arranged to receive waste ink from the print head during maintenance operations;

a waste tank operatively connected to the cap for storing the waste ink;

a control system operatively connected to the print head for:

keeping an estimate of a volume of waste ink that has been discharged into the waste tank; and adjusting the waste ink estimate to compensate for evaporation of the waste ink.

2. The ink jet printer of claim 1, wherein:

the control system is further for:

providing a warning signal when the waste ink estimate reaches a threshold value representative of a portion of a capacity of the waste tank.

3. The ink jet printer of claim 2, wherein:

the control system is further for:

keeping a plurality of operational parameters in a memory where the plurality of operational parameters are used by the control system to adjust the waste ink estimate and determine if the warning signal should be provided, the plurality of operational parameters include at least information relating to one of the following: the waste tank capacity, the threshold value and an evaporation characteristic of the ink.

4. The ink jet printer of claim 3, wherein:

the supply of ink is contained within a replaceable cartridge;

the replaceable cartridge includes a data carrier containing an updated operational parameter of the ink; and the control system is further for:

obtaining from the data carrier the updated operational parameter; and changing the plurality of operational parameters in the memory to reflect the updated operational parameter.

5. The ink jet printer of claim 3, wherein:

the control system is further for:

receiving an updated operational parameter from an external source; and changing the plurality of operational parameters in the memory to reflect the updated operational parameter.

6. The ink jet printer of claim 3, further comprising:

an amount of shipping fluid initially installed within the print head, the amount of shipping fluid having a first set of evaporation characteristics; and wherein:

the waste ink has a second set of evaporation characteristics different from the first set of evaporation characteristics; and the control system is further for:

causing the amount of shipping fluid to be discharged into the waste tank;

including the amount of shipping fluid within the estimate of the volume of waste ink that has been discharged into the waste tank; and adjusting the waste ink estimate in view of differences between the evaporation characteristics of the amount of shipping fluid and the waste ink, respectively.

7. The ink jet printer of claim 3, wherein:

the supply of ink is one of a plurality of supplies of ink, each of the plurality of supplies of ink discharging into the waste tank and having respective evaporation characteristics;

including discharges from each of the plurality of supplies of ink that have been discharged into the waste tank within the estimate of the volume of waste; and adjusting the waste ink estimate in view of differences between the respective evaporation characteristics of the plurality of supplies of ink.

8. The ink jet printer of claim 2, wherein:

the control system is further for:

setting a warning flag in memory after the waste ink estimate reaches the threshold value; and communicating the warning flag to a remotely located data center so as to initiate corrective action.

9. The ink jet printer of claim 1, further comprising:

an amount of shipping fluid initially installed within the print head, the amount of shipping fluid having a first set of evaporation characteristics; and wherein:

the waste ink has a second set of evaporation characteristics different from the first set of evaporation characteristics; and the control system is further for:

causing the amount of shipping fluid to be discharged into the waste tank;

including the amount of shipping fluid within the estimate of the volume of waste ink that has been discharged into the waste tank; and adjusting the waste ink estimate in view of differences between the evaporation characteristics of the amount of shipping fluid and the waste ink, respectively.

10. The ink jet printer of claim 9, wherein:

the control system is further for:

setting a warning flag in memory after the waste ink estimate reaches the threshold value; and communicating the warning flag to a remotely located data center so as to initiate corrective action.

11. A method of operating an ink jet printer, comprising the step(s) of:

providing a supply of ink;

operating a print head connected to the supply of ink for ejecting drops of ink to form an image;

arranging a cap to receive waste ink from the print head during maintenance operations;

storing the waste ink in a waste tank;

keeping an estimate of a volume of waste ink that has been discharged into the waste tank; and adjusting the waste ink estimate to compensate for evaporation of the waste ink.

12. The method of claim 11, further comprising the step(s) of:

providing a warning signal when the waste ink estimate reaches a threshold value representative of a portion of a capacity of the waste tank.

13. The method of claim 12, further comprising the step(s) of:

keeping a plurality of operational parameters used by the control system to adjust the waste ink estimate and determine if the warning signal should be provided in a memory where the plurality of operational parameters include at least information relating to one of the following:

the waste tank capacity, the threshold value and an evaporation characteristic of the ink.

14. The method of claim 13, further comprising the step(s) of:

locating the supply of ink within a replaceable cartridge, the replaceable cartridge including a data carrier containing an updated operational parameter of the ink;

obtaining from the data carrier the updated operational parameter; and changing the plurality of operational parameters in the memory to reflect the updated operational parameter.

15. The method of claim 13, further comprising the step(s) of:

receiving an updated operational parameter from an external source; and changing the plurality of operational parameters in the memory to reflect the updated operational parameter.

16. The method of claim 13, further comprising the step(s) of:

including an amount of shipping fluid within the print head, the amount of shipping fluid having a first set of evaporation characteristics;

providing the waste ink with a second set of evaporation characteristics different from the first set of evaporation characteristics;

causing the amount of shipping fluid to be discharged into the waste tank;

including the amount of shipping fluid within the estimate of the volume of waste ink that has been discharged into the waste tank; and adjusting the waste ink estimate in view of differences between the evaporation characteristics of the amount of shipping fluid and the waste ink, respectively.

17. The method of claim 13, further comprising the step(s) of:

providing a plurality of supplies of ink where the supply of ink is one of the plurality of supplies of ink, each of the plurality of supplies of ink discharging into the waste tank and having respective evaporation characteristics;

including discharges from each of the plurality of supplies of ink that have been discharged into the waste tank within the estimate of the volume of waste ink; and adjusting the waste ink estimate in view of differences between the respective evaporation characteristics of the plurality of supplies of ink.

18. The method of claim 12, further comprising the step(s) of:

setting a warning flag after the waste ink estimate reaches the threshold value; and communicating the warning flag to a remotely located data center so as to initiate corrective action.

19. The method of claim 11, further comprising the step(s) of:

including an amount of shipping fluid within the print head, the amount of shipping fluid having a first set of evaporation characteristics;

providing the waste ink with a second set of evaporation characteristics different from the first set of evaporation characteristics;

causing the amount of shipping fluid to be discharged into the waste tank;

including the amount of shipping fluid within the estimate of the volume of waste ink that has been discharged into the waste tank; and adjusting the waste ink estimate in view of differences between the evaporation characteristics of the amount of shipping fluid and the waste ink, respectively.

20. The method of claim 19, further comprising the step(s) of:

setting a warning flag after the waste ink estimate reaches the threshold value; and communicating the warning flag to a remotely located data center so as to initiate corrective action.

* * * * *